United States Patent [19]

van Nederveen

[11] 4,084,649

[45] Apr. 18, 1978

[54] ROCK BIT

[75] Inventor: Hans Bertil van Nederveen, Bosch en Duin, Netherlands

[73] Assignee: SKF Industrial Trading & Development Company B.V., Jutphaas, Netherlands

[21] Appl. No.: 693,508

[22] Filed: Jun. 7, 1976

[30] Foreign Application Priority Data

Jun. 20, 1975 Netherlands ..... 7507355

[51] Int. Cl.[2] ..... E21B 9/08

[52] U.S. Cl. ..... 175/366; 175/372; 308/8.2

[58] Field of Search ..... 175/356, 360, 365–372; 308/8.2, 16, 19

[56] References Cited

U.S. PATENT DOCUMENTS

| | | | |
|---|---|---|---|
| 1,792,608 | 2/1931 | Reed | 175/372 X |
| 1,961,819 | 6/1934 | DeCosta | 175/369 X |
| 2,065,743 | 12/1936 | Reed | 175/366 |
| 2,075,997 | 4/1937 | Reed | 175/368 X |
| 2,151,347 | 3/1938 | Fisher | 175/369 X |
| 2,339,161 | 1/1944 | Fermier | 175/370 |

*Primary Examiner*—Ernest R. Purser
*Assistant Examiner*—Richard E. Favreau
*Attorney, Agent, or Firm*—Daniel M. Rosen

[57] ABSTRACT

Rock bit for drilling holes in the earth's crust which can be connected to driving means and being provided with supports or rock bit legs in which rotatable cutting elements or cutter cones are journalled, wherein a rock bit support comprises a removable part to which the bearing outer race ring is connected, the support part being a regularly shaped spatial body having edges which, in the assembled position, are situated in boundary planes of the support or rock bit leg.

14 Claims, 2 Drawing Figures

ROCK BIT

The invention relates to a rock bit for drilling holes in the earth's crust wherein the bit can be connected to driving means and is provided with supports or rock bit legs in which rotatable cutting elements or cutter cones are journalled.

A rock bit of this type is e.g. disclosed in the U.S. Pat. No. 3.307.645. It is furthermore known that with these types of rock bits the bearing arrangement usually determines the life of the rock bit. Various measures have already been taken in order to prolong the life of the bearing arrangement e.g. by improving its sealing. However, up to now the problem of efficiently replacing rock bit components in case of e.g. bearing failure or damage of the cutting elements has not been solved.

In order to solve the above described problem, in accordance with the present invention the rock bit support comprises a removable part to which the bearing outer race ring is connected, said support part being a regularly shaped spatial body having edges which in the assembled position are situated in boundary planes of said support or rock bit leg. Due to this measure an easy and secure attachment of said support part is obtained whilst replacing of an improper functioning cutting element or cutter cone now can be carried out in a simple way, i.e. the replacement does not demand any drastic action and could also be carried out near or on the drilling location itself, as distinguished from the rock bit assembly such as is disclosed in the German Pat. No. 726.937. This known rock bit assembly comprises cutting elements each of which is provided with a stem or shaft of particular shape. To connect said shafts in the support special ring like means have to be applied which make the assembly complicated and expensive. In addition, the attachment of said ring means by screwing hinders a replacement on the drilling site.

According to a favourable embodiment of the invention the removable support part has the form of an obliquely truncated three-sided prism which fits as a wedge in the said support. Due to this feature positioning of the removable part in its support is optimum and load distribution more equally divided in said support.

According to another embodiment of the invention a race ring of the bearing arrangement is attached to the removable support part by means of electron beam welding. Due to this method a highly accurate and reliable connection between said race ring and support part is obtained.

One constructional form of the invention will now be described with reference to the accompanying drawing.

Figure 1:
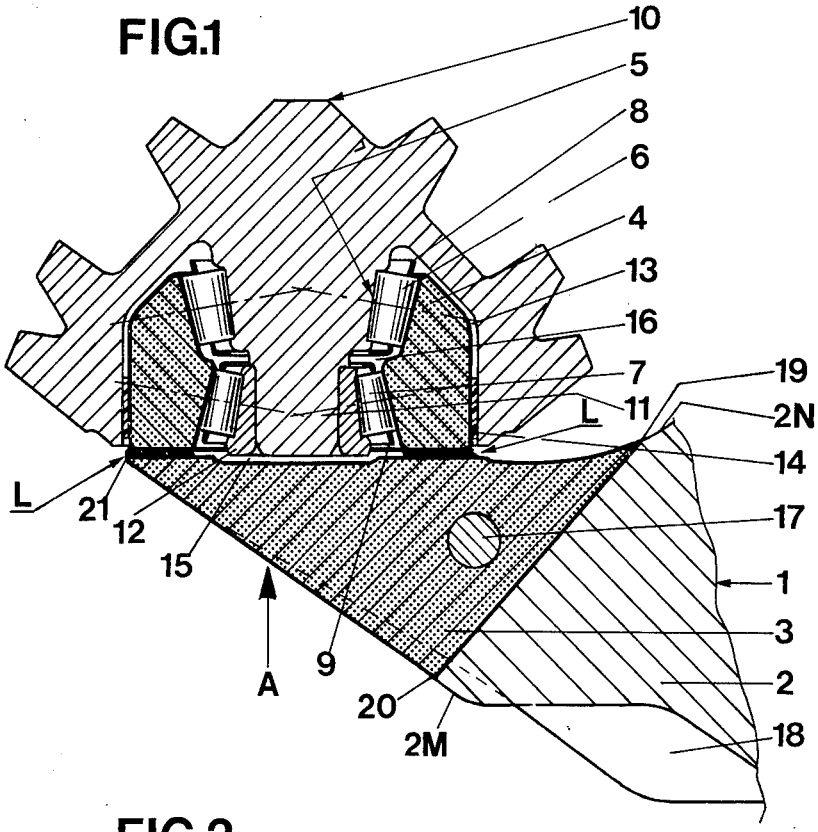
Figure 2:
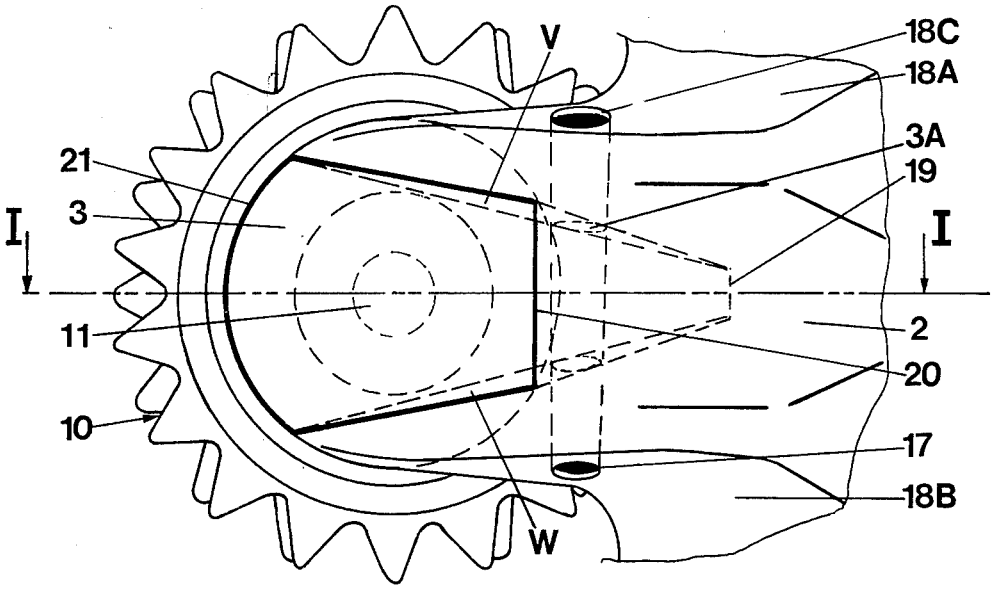

FIG. 1. shows a part of the rock bit with a sectional elevation of the bit support, bearing arrangement and cutting element; taken along the lines I—I of FIG. 2.

FIG. 2. shows a bottom view of the support of FIG. 1;

Referring to the drawing the rock bit 1 comprises a support 2 of which part 3 — shaded in the opposite direction — forms the removable part of the support 2 (see also FIG. 2). In the assembled position the planes of part 3 also form the limitation planes of support 2; in other words, this removable support part forms an integrated unit with support 2. To the support part 3 a ring-shaped element 4 is connected, this connection L being effected by electron beam welding method. An advantage of this welding is that a highly accurate attachment between element 4 and the removable support part 3 is achieved, which is of great importance in view of the function of this element. Element thus forms a race ring of the bearing arrangement 5, therefore an accurate determination of its position must be guaranteed, in view of the bearing tolerances between said element 4 and the rolling bodies 6 and 7. This is obtained by means of said welding method. Although not shown, it is also possible to attach an inner race-ring instead of the outer race-ring 4 to the part 3 by election beam welding method. It is also within the scope of the invention to form the outer race ring and the removable part 3 as one unit. The bearing arrangement comprises two rows of taper roller bodies 6 and 7 having different dimensions and capacity.

Preferably an 0 - position between the two rows of rolling bodies is employed by means of which an optimum bearing load capacity can be achieved. The 0-position refers to the condition wherein the lines of action of the load through the individual bearing contacts diverge at the rotational axis of the structure, as indicated by the dash-dot loading lines shown in FIG. 1. It is seen that the load lines thus form and "0". This arrangement is therefore relatively rigid. Roller bodies 6 and 7 are separated in their rows by means of cages 8 or 9, implementing inter alia good functioning and optimum load distribution of the bearing arrangement. Instead of tapered rolling bodies, e.g. spherical rolling bodies can be employed with favourable results. It is further advantageous that the cutting element 10 is centrally provided with a shaft part 11, which serves as an inner race-ring for the rolling bodies 6 and at the same time a support means for a separate inner race-ring 12 for the rolling bodies 7. Between the outer ring 4 and the cutting element 10 exists, according to the sectional view of FIG. 1, a relatively long slot-like chamber 13 in which a relatively broad sealing ring 14 is fitted, which guarantees good sealing of the bearing arrangement. Furthermore, between the shaft and part 11 of the cutting element 10 and the removable part 3, a space 15 exists. Also on account of this, a relatively large room is created — consisting of space 15, chamber 16 situated between the roller elements 6 and 7, as well as the slot-like chamber 14 — in which a generous quantity of a lubricant can be accommodated such that the life, the running characteristics and the carrying capacity of the bearing system can be favourably influenced. Furthermore it may be stated that the bearing arrangement 5 can be considered as one of the simpliest executions possible for this kind of rock bit construction, whereby optimum operating safety and relatively long life is combined. The removable support part 3 with bearing arrangement 5 and cutting element 10 is furthermore mounted to the support 2 by means of a taper pin 17, which as is further shown in FIG. 2, fits through fork parts 18 of support 2 and part 3. This pin or shaft can, if necessary, be provided with known retaining means in support 2.

FIG. 2 shows the bit support 2 with cutting element 10 and the wedge-shaped removable part 3, as well as in particular the attachment of part 3 in the bit support 2. The wedge-shaped part 3 is a regularly formed spatial body and has in this preferred embodiment the form of an obliquely truncated three-sided prism, of which the edges 19, 20 and 21 are situated in the outside planes 2M and 2N (see FIG. 1) which are generally defined by support 2. The triangular side planes V and W of part 3 converge, — seen from edges 20 — toward the center of the cutting device 10. It is furthermore of importance that planes V and W are entirely situated against the side planes of the fork-shaped supports parts 18A and 18B of support 2, so that a maximum all-sided support between planes V and W and fork parts 18A and 18B is obtained. By this embodiment, at least in the operating position, the removable part 3 practically form one unit with fork supports 18A and 18B, as a result of which it may be stated that by the specific bearing mounting of this part in bit support 2, optimum operation on the one hand and simply assembly or dismantling of a cutting element on the other hand is achieved.

The mounting of the cutting element 10 to the bit support 2 of the rock bit 1 is as follows: On the shaft part 11 which forms the inner race ring of the bearing arrangement 5, taper roller bodies 6 and cage 8 are fitted in the same way as in case of other rolling bearing arrangements; and the row of bodies 7 with cage 9 are fitted to a separate race ring 12. Subsequently the outer ring 4 adapted to the form of the bearing (6, 7) is slid over the rotating bodies 6 is connected. Next, the race ring 12 with the taper roller bodies 7 are fitted into the recess formed by the shaft part 11 and outer ring 4. To the completed rock bit cone 10, support part 3, by means of electron beam welding. After this mounting the composite bit element (3, 5, 10) is slid as a wedge from the outside of the rock bit between the fork parts 18A and 18B and subsequently fixed by inserting pin 17 into the corresponding openings 18C and 3A of the fork parts 18A and 18B and part 3, to the support part 2 of said rock bit 1. It will be appreciated that according to the invention the composite rock bit element or cutter cone 3, 5, 10 in case of cone failure now can be easily replaced, thus preventing unacceptable loss of drilling time and need of particular or complicated mounting actions.

What we claim is:

1. In a rock bit for drilling holes in the earth's crust, wherein rotatable cutting elements are journalled in supports, the supports being adapted to be coupled to rock bit driving means; the improvement wherein said supports are comprised of a base portion having a recess and a removable portion removably held by said base portion, said cutting elements being journalled in said removable portion, said removable portion having the shape of a solid prism and being removably fitted to said base portion in said recess with all of the edges of the prism lying in planes generally defined by the outer surfaces of said base portion outside of said recess.

2. The rock bit of claim 1 further comprising outer race-ring means affixed to one side of said prism, inner race-ring means forming a central shaft on said cutting element and extending into said outer race-ring means, whereby a plurality of race-rings of different diameters are formed between said outer race-ring means and inner race-ring means, and tapered rolling elements in said race rings for rotatably supporting said cutting element from said removable portion.

3. The rock bit of claim 1, wherein said removable portion has the shape of a prism the edges of which lie in the boundary planes of said base portion.

4. The rock bit of claim 3, wherein said prism is an obliquely truncated triangular prism, the end faces of which engage said base portion.

5. The rock bit of claim 3, comprising means for journalling said cutting elements to one side of said prism, said prism being obliquely truncated on each end, with the planes of the end faces converging in the direction thereof toward said base portion.

6. The rock bit of claim 5, wherein said base portion is forked, said end faces of said prism lying completely against the inside surfaces of the fork of said base portion.

7. The rock bit of claim 6, comprising removable pin means extending through the forked portion of said base portion and said removable portion for removably holding said removable portion to said base portion.

8. The rock bit of claim 7, wherein said pin means comprises a tapered pin, said tapered pin extending through said removable portion adjacent said means for journalling said cutting elements to said removable portion.

9. The rock bit of claim 6, wherein said prism is a triangular prism.

10. The rock bit of claim 3, wherein said cutting element is journalled to one side of said prism, and further comprising rolling bearing means for said cutting element, said rolling bearing means comprising a first race-ring on said cutting element and a second race-ring connected to said side of said prism.

11. The rock bit of claim 10, wherein said second race-ring comprises an outer race-ring, and said second race ring is connected to said removable portion by electron beam welding.

12. The rock bit of claim 11, wherein said first race-ring comprises a central shaft on said cutting element, and tapered rolling elements between said race-rings, said central shaft forming the inner race-ring of said rolling bearing means.

13. In a rock bit for drilling holes in the earth's crust, wherein a rotatable cutting element is journalled in a support, the support being adapted to be coupled to rock bit driving means; the improvement wherein said support comprises a base portion having a pair of forks extending outwardly therefrom, and a removable portion in the form of a prism having edges lying in planes generally defined by the outer surfaces of the forks of said base portion, said prism being a triangular prism and having obliquely truncated end faces completely engaging the inside surfaces of said forks, the planes of said end faces converging inwardly of said rock bit, pin means extending through said forks and said removable portion to enable removing of said removable portion from said base portion, and means journalling said cutting element to a side of said prism.

14. The rock bit of claim 13, wherein said means for journalling comprises an outer race ring affixed to said side of said prism, a central shaft on said cutting element and extending into said outer race ring, whereby said central shaft forms an inner race ring, and a plurality of rows of rolling elements between said inner and outer race rings.

* * * * *

UNITED STATES PATENT AND TRADEMARK OFFICE

CERTIFICATE OF CORRECTION

PATENT NO. : 4,084,649

DATED : April 18, 1978

INVENTOR(S) : Hans Bertil van Nederveen

It is certified that error appears in the above-identified patent and that said Letters Patent are hereby corrected as shown below:

Column 1, line 5, after "crust" insert --,--.

Column 1, line 17, after "elements" insert --,--.

Column 1, line 35, after"support" insert --,--.

Column 2, line 2, after "Element" insert --4--.

Column 2, line 9, change "election" to --electron--.

Column 2, line 22, change "and" to --an--.

Column 3, line 24, change "3,by" to --3 is connected by--.

Column 3, line 31, "It will" should start a new paragraph.

Column 3, line 51, change "1" to --3--.

Signed and Sealed this

*Fifth* Day of *September 1978*

[SEAL]

*Attest:*

RUTH C. MASON
*Attesting Officer*

DONALD W. BANNER
*Commissioner of Patents and Trademarks*